US005578428A

United States Patent [19]

Fyson

[11] Patent Number: 5,578,428

[45] Date of Patent: Nov. 26, 1996

[54] PROCESS AND APPARATUS FOR THE PEROXIDE BLEACHING OF PHOTOGRAPHIC MATERIALS

[75] Inventor: John R. Fyson, Hackney, United Kingdom

[73] Assignee: Eastman Kodak Company, Rochester, N.Y.

[21] Appl. No.: 572,375

[22] Filed: Dec. 14, 1995

[30] Foreign Application Priority Data

Dec. 17, 1994 [GB] United Kingdom ..... 9425508

[51] Int. Cl.[6] ..... G03C 7/44

[52] U.S. Cl. ..... 430/398; 430/393; 430/400; 430/430; 430/460; 430/461

[58] Field of Search ..... 430/393, 398, 430/400, 430, 460, 461

[56] References Cited

U.S. PATENT DOCUMENTS 3,832,453 8/1974 Slovonsky et al. ..... 423/561
4,277,556 7/1981 Koboshi et al. ..... 430/393
5,342,740 8/1994 Goto et al. ..... 430/400

FOREIGN PATENT DOCUMENTS

0514868A1 11/1992 European Pat. Off.
1199860 7/1970 United Kingdom .

*Primary Examiner*—Hoa Van Le
*Attorney, Agent, or Firm*—J. Lanny Tucker

[57] ABSTRACT

A process for the bleaching of an exposed photographic material utilizes a peroxide bleach solution to remove metallic silver from the exposed photographic material. The silver from the photographic material passes into the bleach solution such that at least part of the excess silver over that required to catalyze the bleaching action is removed from the bleach solution by forming an insoluble silver compound, for example, by the addition of a halide. The invention provides an apparatus for use in the bleaching method.

6 Claims, 1 Drawing Sheet

Replenisher
Halide solution
2
3
4
6
8
10
12
14
16
18
20

PROCESS AND APPARATUS FOR THE PEROXIDE BLEACHING OF PHOTOGRAPHIC MATERIALS

FIELD OF THE INVENTION

This invention relates to the processing of photographic materials, more particularly to the removal of silver from exposed photographic materials by an improved bleaching process and to an apparatus therefor.

BACKGROUND OF THE INVENTION

In color photography development it is necessary at an appropriate stage to remove the silver image, which, if left behind, would darken the dye image. Also it is necessary to remove unused silver halide because it darkens on exposure to light.

To remove the silver it has been previously proposed to convert it to silver halide with a suitable oxidizing agent known in the art as a bleach such as potassium ferricyanide or ferric iron complexed with ethylene diamine tetraacetic acid acting in the presence of potassium bromide. Alternatively, it has been proposed to use hydrogen peroxide as the bleach. The bleaching action of the peroxide is catalyzed by silver. Such a bleach has been described in U.S. Pat. No. 4,277,556 and has been referred to in the art as being of the "solvent type" because the silver is taken directly into solution and not converted to halide.

Under the action of a solvent bleach, soluble silver ions are formed and washed out of the photographic material and, as a result, build up in the bleach solution. This means that with solvent bleaches there is a risk of increased carryover of silver to the next stage of the process. Silver ions are environmentally undesirable. In order to minimize any silver being discharged, the silver ion concentration in the bleach should be kept low. This is usually achieved by adding replenisher at a rate to keep any carryover low. However this replenisher displaces silver-containing solution and the displaced solution must be desilvered in some way off line.

This problem has been solved by the present invention by removing at least part of the excess silver as an insoluble compound, for example, by adding a halide. The excess silver is the difference between the amount of silver actually in the solution and the amount necessary to catalyze the bleach action.

SUMMARY OF THE INVENTION

According to the present invention a process for the bleaching of an exposed photographic material comprises using a peroxide bleach solution to remove metallic silver from the exposed photographic material and in which process the silver from the photographic material passes into the bleach solution, wherein at least part of the excess silver over that required to catalyze the bleaching action is removed from the bleach solution by forming an insoluble silver compound.

According to another aspect of the present invention, an apparatus for the bleaching of exposed photographic materials and removing silver from the bleach solution comprises a tank (2) for holding the bleach solution, a recirculation system (3) by means of which solution may be withdrawn from the tank (2) and returned thereto, an inlet (14) to the recirculation system (3) suitable for the addition to the recirculating solution of a halide solution and means for the removal of precipitated solids (10) so that the recirculating solution returned to the tank (2) is free of precipitated solids and thus depleted in silver.

The removal of the excess silver from the bleach solution reduces the amount of silver that is present in the main liquid waste stream. Further it enables the volume of bleach replenisher to be reduced and at the same time maintain the concentration of silver in the bleach constant. In addition the precipitation of the excess silver as a solid such as a halide means that it is recovered as an easily refinable solid.

BRIEF DESCRIPTION OF THE DRAWINGS

The FIGURE is a simplified flow diagram showing one way in which the invention can be carried out.

DETAILED DESCRIPTION OF THE INVENTION

Figure 1:
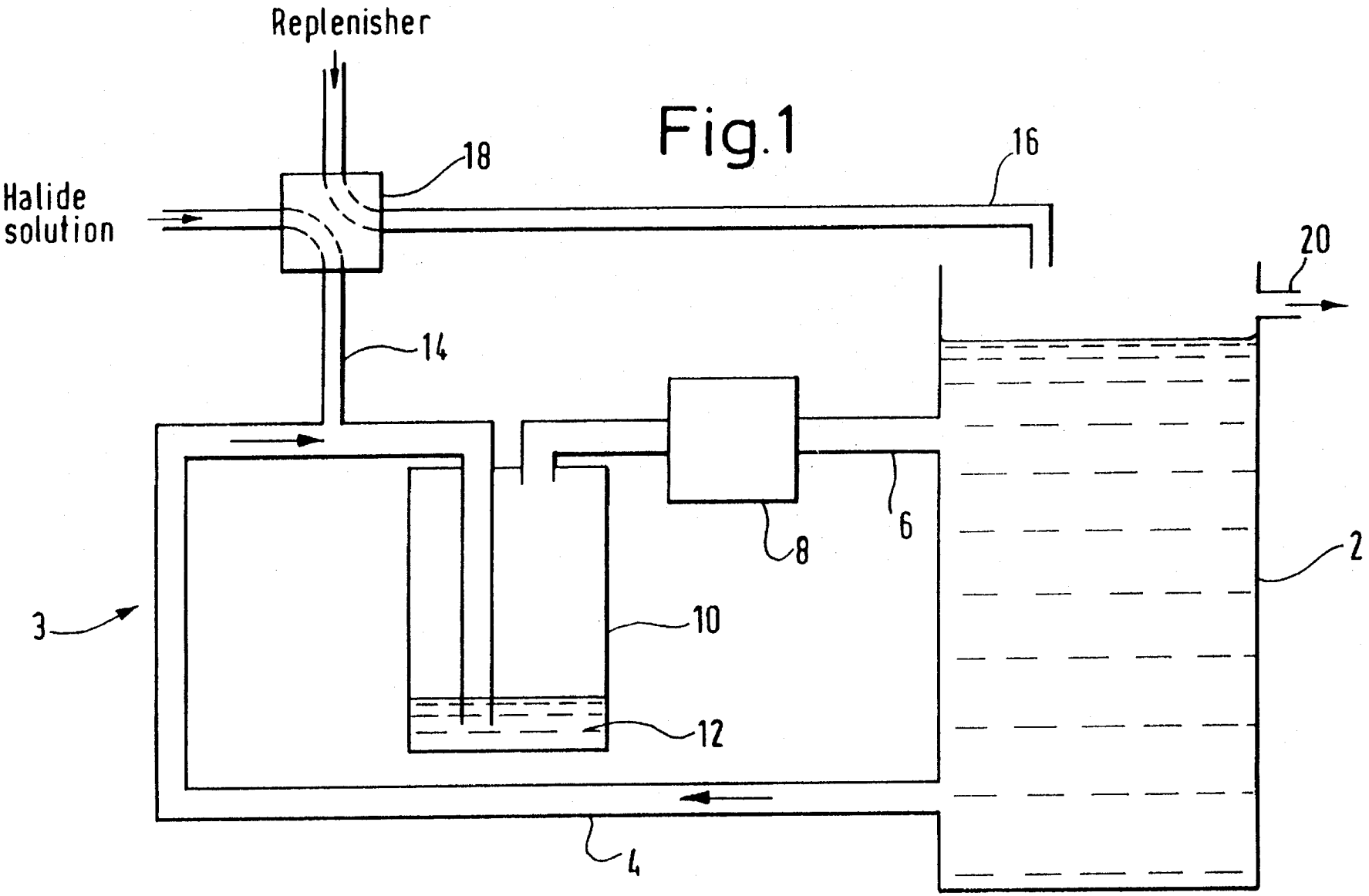

Reference to hydrogen peroxide in the present specification includes compounds that release hydrogen peroxide.

The bleaching action of the peroxide is catalyzed by silver in the bleach solution and the rate of bleaching increases with increasing silver concentration over a range of silver concentrations. When the silver concentration is progressively reduced it is found that the bleaching rate also falls progressively and a point is reached below which the rate of bleaching is too slow to be of practical use. References in the present specification to there being sufficient silver to catalyze the bleaching action mean that the silver concentration is above this minimum concentration.

Preferably, the concentration of silver is substantially above the minimum in order to achieve a shorter bleaching time and therefore the amount of silver removed by the present invention will only be a fraction of the excess silver. For example, it is preferred that the concentration of silver in the bleach is at least equivalent to 0.25 g/l of silver nitrate, more preferably at least 0.50 g/l.

According to one embodiment of the present invention the concentration of silver in the bleach solution is controlled within the range equivalent to 0.25 to 2.0 g/l of silver nitrate.

The bleach process may be carried out as described in U.S. Pat. No. 4,277,556 for example at a temperature in the range 15° to 60° C. with a pH of the bleach solution from 2.0 to 5.5 and with the bleach containing from 0.05 to 3 moles/liter of hydrogen peroxide or perborate.

The insoluble silver compound may be formed by the addition of a halide to the bleach solution.

Preferably the halide is one that is water soluble and preferably is added as an aqueous solution.

The bleach process may be performed in a tank and the halide may be added to a recirculating stream withdrawn from the tank and a stream from which the silver has been removed returned to the tank.

Bleach replenisher may be added and the replenisher may be added to the recirculating stream. In order to prevent precipitation of silver halide in the processing tank, the replenisher or at least that part of it that contains the halide is metered in to the recirculation system before a filter or solid trap. The silver halide may be removed from the trap at intervals and the silver recovered.

The amount of halide added is preferably controlled so that it is proportional to the amount of material processed.

The process can be used for any photographic process where bleach is employed, e.g., color paper, color film both negative and reversal and reversal black and white materials.

Referring to the FIGURE, the apparatus comprises a tank (2) for holding peroxide bleach and in which the bleach process is carried out. The tank has an overflow outlet (20). The tank also has a recirculation system indicated generally by reference numeral (3), by means of which solution may be withdrawn from the tank (2) and returned thereto. The recirculation system comprises an outlet line (4) through which solution may be withdrawn and returned by inlet line (6) via pump (8). The line (4) is joined by an inlet line (14) through which halide solution may be added to the recirculating solution and a trap (10) where precipitated silver halide (12) is removed from the recirculating liquid before return to tank (2). The tank (2) has a further inlet pipe (16) through which replenisher solution may be passed to the tank assisted by pump (18) which can also serve as the pump for the halide solution.

The invention is illustrated by the following examples.

EXAMPLE 1

In Run 1 of this example an ISO 400 speed black and white film with a silver laydown of 4.4 g/m$^2$ of 4% tabular grain bromoiodide emulsion was exposed to room light. It was then processed in small upright tanks in a black and white developer of the following composition:

| Developer | |
|---|---|
| p-methylaminophenol sulphate | 2.5 g |
| ascorbic acid | 10 g |
| potassium bromide | 1 g |
| disodium tetraborate | 35 g |
| sodium sulphite | 3 g |
| water to | 1 liter |
| pH adjusted to 9.8 with sodium hydroxide. | |

The film was stopped, washed and then bleached in a bleach of the composition of Table 1, monitoring the silver density continuously by measuring the infra-red transmission of the film:

Bleach:

TABLE 1

| | |
|---|---|
| water | 850 g |
| acetic acid (glacial) | 85 g |
| 30% w/w hydrogen peroxide | 64 g |
| silver nitrate | 0.75 g |
| pH adjusted to 4.5 with sodium hydroxide. | |

The process times and temperatures were as follows:

| | | |
|---|---|---|
| develop | 2.5 mins | 37.8° C. |
| stop | 1.0 min | 37.8° C. |
| wash | 1.0 min | 37.8° C. |
| bleach | * | 37.8° C. |

*time when infra-red density ceased to change was recorded as the bleach time in Table 2.

Runs 2 to 10

The procedure of Run 1 was repeated and bleaches of the composition of Table 1 were prepared except that more silver nitrate was added to simulate seasoning of the bleach (Runs 2 to 3 and 5 to 10). For Run 4 a bleach containing less silver nitrate was prepared. The initial concentrations of silver nitrate are given in Table 2. To these bleaches calculated amounts of 10% (g/v) sodium halide solutions were added to return the silver concentration for Runs 2 and 3 and 7 to 10 to the initial level in Run 1, and for Runs 5 and 6 to that of Run 4. The silver was precipitated and filtered off before the bleaching rate was measured. Some of the experiments were carried out with the bleach at pH 4.0 and different halides were used to precipitate the silver. The details are given in Table 2.

TABLE 2

| Run | Initial AgNO3 Concentration (g/l) | Volume of Halide (ml) | Equivalent AgNO3 in solution (g/l) | pH | Bleach time (sec) |
|---|---|---|---|---|---|
| 1 | 0.75 | none | 0.75 | 4.5 | 95 |
| 2 | 1.5 | 2.6 NaCl | 0.75 | 4.5 | 93 |
| 3 | 2.25 | 5.2 NaCl | 0.75 | 4.5 | 96 |
| 4 | 0.38 | none | 0.38 | 4.0 | 231 |
| 5 | 1.5 | 3.9 NaCl | 0.38 | 4.0 | 235 |
| 6 | 2.25 | 6.5 NaCl | 0.38 | 4.0 | 232 |
| 7 | 1.5 | 4.5 NaBr | 0.75 | 4.5 | 94 |
| 8 | 2.25 | 9.1 NaBr | 0.75 | 4.5 | 93 |
| 9 | 1.5 | 6.6 NaI | 0.75 | 4.5 | 95 |
| 10 | 2.25 | 13.2 NaI | 0.75 | 4.5 | 94 |

Runs 1 and 4 are not according to the invention and are included for comparative purposes.

Comparing Runs 2 and 3 with Run 1 it can be seen that the addition of chloride did not have a significant adverse effect on the bleaching time but that it did reduce the amount of silver in solution.

Comparison of Runs 7 and 8 with Run 1 shows the same effect in the case of the addition of bromide and Runs 9 and 10 compared with Run 1 show the same effect with the addition of iodide. Runs 5 and 6 compared with Run 4 show the same effect at a lower silver concentration. This example demonstrates that in principle use of the invention will result in less silver being carried over to the next stage of the process or displaced in the overflow by addition of replenisher.

EXAMPLE 2

The Runs in this Example were carried out using the apparatus shown in the FIGURE. The replenishment pump 18 had two heads linked. From one the bleach replenisher was added and from the other 10% solution sodium chloride solution such that when one was being replenished the other was also. However the rate of replenishment could be varied independently. The recirculation system (3) took the bleach solution through the trap (10) where the silver halide was removed. Film (as used in Example 1, but only 25% exposed to room light and 75% unexposed to simulate standard exposure) was processed through the tank and replenishment made to maintain the silver at a constant level of 0.75 g/l (as the nitrate). Run 1 was carried out with no sodium chloride added using bleach replenisher of the composition given in Table 3 (on both runs the bleach tank was filled with the comparison bleach formula described in Example 1).

Bleach replenisher

TABLE 3

| | |
|---|---|
| water | 850 g |
| acetic acid (glacial) | 85 g |
| 30% w/w hydrogen peroxide | 64 g |
| pH adjusted to 4.0 with sodium hydroxide. | |

The processor was replenished to keep the silver level constant. The results and optimum replenishment rates are given in Table 5. Residual silver in the film was measured by X-ray fluorescence spectroscopy. The process times and temperatures were:

| | | |
|---|---|---|
| develop | 2.5 mins | 37.8° C. |
| stop | 1.0 min | 37.8° C. |
| wash | 1.0 min | 37.8° C. |
| bleach | 2.0 mins | 37.8° C. |
| "Kodak" fixer C-41 | 4.0 mins | 37.8° C. |
| wash | 3.0 mins | 37.8° C. |

Run 2 repeated the procedure of Run 1 except that 10% sodium chloride was added to the recirculation system by line (14). Because silver was being removed from the bleach it was possible to add a smaller volume of more concentrated replenisher and at the same time maintain the concentration of silver in the bleach constant. The replenisher was added via line (16) and was of the composition given in Table 4.

Bleach replenisher

TABLE 4

| | |
|---|---|
| water | 580 g |
| acetic acid (glacial) | 250 g |
| 30% hydrogen peroxide | 188 g |
| pH adjusted to 4.0 with sodium hydroxide. | |

TABLE 5

| Run No | 10% NaCl flow rate mls/m$^2$ | replenisher flow rate mls/m$^2$ | silver lost to drain g/m$^2$ |
|---|---|---|---|
| 1 | zero | 2100 | 1.1 |
| 2 | 6.6 | 93.4 | 0.048 |

Run 1 was not according to the invention and is included for comparative purposes. In neither Run was there any significant amount of silver retained (less than 5 mg/m$^2$) in the film.

Comparison of Run 1 with Run 2 shows that the addition of the halide together with a more concentrated bleach replenisher reduced the amount of silver displaced by the replenisher from the bleach tank and hence going to drain by 95.7% . o There were also savings in the hydrogen peroxide and acetic acid consumed of about 87%.

EXAMPLE 3

Example 1 was repeated except that the film was Gold II 400 and "Kodak" C-41 developer was used in place of the black and white developer. The results are shown in Table 6.

TABLE 6

| Run | Initial AgNO3 Concentration (g/l) | Volume of Halide (ml) | Equivalent AgNO3 in solution (g/l) | pH | Bleach time (sec) |
|---|---|---|---|---|---|
| 1 | 0.75 | none | 0.75 | 4.5 | 181 |
| 2 | 1.5 | 2.6 NaCl | 0.75 | 4.5 | 176 |

TABLE 6-continued

| Run | Initial AgNO3 Concentration (g/l) | Volume of Halide (ml) | Equivalent AgNO3 in solution (g/l) | pH | Bleach time (sec) |
|---|---|---|---|---|---|
| 3 | 2.25 | 5.2 NaCl | 0.75 | 4.5 | 185 |
| 4 | 0.38 | none | 0.38 | 4.0 | 351 |
| 5 | 1.5 | 3.9 NaCl | 0.38 | 4.0 | 354 |
| 6 | 2.25 | 6.5 NaCl | 0.38 | 4.0 | 341 |
| 7 | 1.5 | 4.5 NaBr | 0.75 | 4.5 | 186 |
| 8 | 2.25 | 9.1 NaBr | 0.75 | 4.5 | 184 |
| 9 | 1.5 | 6.6 NaI | 0.75 | 4.5 | 183 |
| 10 | 2.25 | 13.2 NaI | 0.75 | 4.5 | 180 |

Runs 1 and 4 are not according to the invention and are included for comparative purposes.

Runs 2 and 3 should be compared with Run 1.

Runs 5 and 6 should be compared with Run 4.

Runs 7 to 10 should be compared with Run 1.

The above Examples show that the addition of halide does not have a significant adverse effect on the rate of bleaching. This is unexpected since it is known that the presence of halide can have an adverse effect on the bleaching rate.

The invention has been described in detail with particular reference to preferred embodiments thereof, but it will be understood that variations and modifications can be effected within the spirit and scope of the invention.

I claim:

1. A process for the bleaching of an exposed photographic material comprises using a peroxide bleach solution to remove metallic silver from the exposed photographic material and in which process the silver from the photographic material passes into the bleach solution, wherein at least part of the excess silver over that required to catalyze the bleaching action is removed from the bleach solution by forming an insoluble silver compound the concentration of the silver in said peroxide bleach solution be at least equivalent to 0.25 g/l of silver nitrate.

2. A process as claimed in claim 1 wherein the concentration of silver in the bleach solution is controlled within the range equivalent to 0.25 to 2.0 g/l of silver nitrate.

3. A process as claimed in claim 1 wherein the insoluble silver compound is a silver halide formed by adding a halide to the bleach solution.

4. A process as claimed in claim 3 wherein the amount of halide added is proportional to the amount of photographic material processed.

5. A process as claimed in claim 3 wherein the bleaching is carried out in a bleach processing tank wherein the silver is removed from a recirculating stream withdrawn from the bleach processing tank and a stream from which the silver has been removed returned to the tank.

6. A process as claimed in claim 5 in which a bleach replenisher is added wherein the replenisher is added to the recirculating stream.

* * * * *